US005797281A

United States Patent [19]

Fox

[11] Patent Number: 5,797,281

[45] Date of Patent: Aug. 25, 1998

[54] EARRING ASSEMBLY WITH INTERCHANGEABLE DECORATIVE RINGS

[76] Inventor: Carole D. Fox, 61 Centre Street N., Brampton, Ontario, Canada, L6V 1T1

[21] Appl. No.: 833,270

[22] Filed: Apr. 4, 1997

[51] Int. Cl.[6] ..... A44C 7/00

[52] U.S. Cl. ..... 63/12; 63/13; 63/40

[58] Field of Search ..... 63/12, 13, 14.1, 63/40, 21, 35, DIG. 3

[56] References Cited

U.S. PATENT DOCUMENTS

| | | | |
|---|---|---|---|
| 1,383,104 | 6/1921 | Grossman | 63/40 |
| 4,253,178 | 2/1981 | Kolaczia | 368/285 |
| 4,655,054 | 4/1987 | Roesch | 63/13 |
| 4,753,828 | 6/1988 | Francis et al. | 427/60 |
| 4,793,155 | 12/1988 | Law | 63/2 |
| 4,959,890 | 10/1990 | Pazurek | 24/113 MP |
| 4,982,580 | 1/1991 | Otenbaker | 63/2 |
| 5,505,061 | 4/1996 | Fleury, Jr. et al. | 63/29.1 |

*Primary Examiner*—Kien T. Nguyen
*Attorney, Agent, or Firm*—Bereskin & Parr

[57] ABSTRACT

An earring assembly comprises an annular earring base with an upwardly extending threaded cylindrical collar that engages attachably with a plurality of interchangeable decorative rings. Each interchangeable decorative ring has an engagement surface with an oppositely threaded mateable formation for individually securing the ring to the base. The base is connected to attachment means for releasable attaching the base to a wearer's ear lobe, such as a post and clutch. In use, a wearer assembles the earring assembly by threading variously coloured and designed decorative rings onto the base's cylindrical collar.

15 Claims, 1 Drawing Sheet

EARRING ASSEMBLY WITH INTERCHANGEABLE DECORATIVE RINGS

FIELD OF THE INVENTION

This invention relates to earrings, more particularly, earring assemblies having interchangeable decorative elements.

BACKGROUND OF THE INVENTION

The desirability of allowing jewelry wearers to coordinate jewelry accessories such as earrings, with clothing and other jewelry items, is well established. While earring assemblies with interchangeable ornaments are known, many commercially available interchangeable earring assemblies utilize components which are not easily manipulated by the earring wearer.

For example, U.S. Pat. No. 4,655,054 to Roesch, discloses a variety of small fastening elements to adapt an ornament to be a earring, brooch, or necklace ornament. However, since these fastening elements are relatively small and difficult to handle, they cause significant inconvenience to earring wearers who generally like to be able to interchange ornaments quickly and conveniently. There is accordingly a need for an interchangeable earring assembly which allows earring wearers to easily interchange decorative elements using attachment components with dimensions easily manipulated by the wearer's fingers.

Other known earring assembly adaptive mechanisms are prone to metal fatigue and breakage. For example, U.S. Pat. No. 5,505,061 to Fleury et al., discloses a post and recess attachment mechanism which allows the user to interchangeably attach "dangle"-type ornaments to an earring mount. Since this mechanism incorporates a relatively thin metal post, it is subject to deformation and breakage as the device is subjected to continued use. Further, since the post is secured frictionally and not mechanically, there is a potential for the attached ornament to detach from the assembly over time.

While Pazurek U.S. Pat. No. 4,959,890 discloses an interchangeable snap button system which provides for the securing of decorative discs to either button or earring clips, it is particularly subject to detachment if pressure is applied unintentionally to the snap interface. Accordingly, there is a need for an earring assembly which is constructed in such a fashion so as to be substantially impervious to deformation and breakage through repeated use as well as to inadvertent ornament detachment.

SUMMARY OF THE INVENTION

The present invention is directed to an earring assembly, comprising a base, attachment means and a removable decorative ring. The base comprises an annular flange having an inner edge and an outer edge, and a cylindrical collar having an outside engagement surface extending upwards from the annular flange. Attachment means are coupled to the base for releasably attaching the base to a wearer's ear lobe. The decorative ring is dimensioned to fit around the collar, and has an inside engagement surface shaped to mate with the outside engagement surface of the collar.

The subject earring assembly preferably includes a plurality of interchangeable decorative ring elements. The outside engagement surface of the collar and the inside engagement surface of the ring are preferably threaded. The ring may be a bezel with a threaded inner engagement surface, and the collar may have an outside diameter sized to receive the bezel, the outside engagement surface of the collar being threaded to mate with the threaded inside surface of the bezel.

The engagement surfaces of the cylindrical collar and of the ring are preferably hidden from view when the base is engaged with the ring. The annular flange of the present invention may have a larger outer diameter than the outer diameter of the ring, to allow the wearer to easily grasp and manipulate the base and ring components.

BRIEF DESCRIPTION OF THE DRAWINGS

The invention will now be described, by way of example only, with reference to the following drawings, in which.

DETAILED DESCRIPTION OF THE PREFERRED EMBODIMENT

Figure 1:
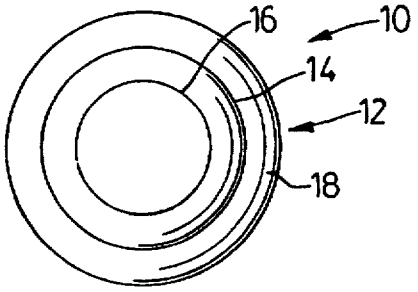
FIG. 1 is a top perspective view of a preferred embodiment of an earring assembly made in accordance with the present invention.

Referring to FIG. 1, illustrated therein is an earring assembly 10 made in accordance with a preferred embodiment of the present invention. Earring assembly 10 comprises a base 12 and a removable interchangeable decorative ring 14. Base 12 includes a cylindrical collar 16 and an annular flange 18 extending perpendicularly therefrom.

Figure 2:
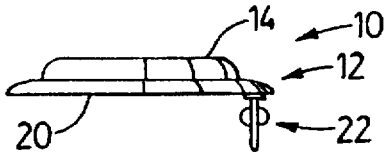
FIG. 2 is a side view of the preferred embodiment of the present invention.

As shown in FIG. 2, base 12 of the earring assembly 10 has a flat bottom surface 20. Mounting apparatus 22 extends perpendicularly from flat bottom surface 20.

Figure 3A:
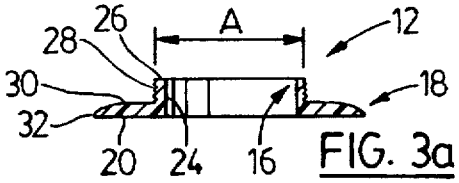
FIG. 3*a* is a cross-sectional view of disengaged base portion of the earring assembly shown in FIG. 1.

Referring now to FIG. 3*a*, collar 16 of base 12 has a smooth inside surface 24, a flat top surface 26, and a threaded outside engagement surface 28. Annular flange 18 of base 12 has a flat top surface 30, flat bottom surface 20, and a rounded outside edge 32. Base 12 is preferably fabricated from an aesthetically pleasing metallic material such as a gold alloy, to provide an attractive appearance, although other materials may be used.

Figure 3B:
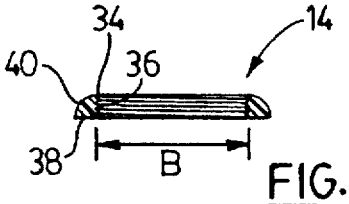
FIG. 3*b* is a cross-sectional view of disengaged ring portion of the earring assembly shown in FIG. 1.

As shown in FIG. 3*b*, decorative ring 14 has a small top lip 34, an inner threaded engagement surface 36, a flat bottom surface 38, and a rounded outside edge 40. Decorative ring 14 is preferably fabricated out of multicolored plastic with plain and decorative patterns, although it could as easily be formed out of other materials such as metal, resin, treated wood or glass.

Referring now to FIGS. 3*a* and 3*b*, the outside diameter A of collar 16 is dimensioned to be slightly smaller that the inside diameter B of decorative ring 14, and the threads of engagement surface 36 of decorative ring 14 are shaped so as to mate with the threads of outer engagement surface 28 of collar 16. When the collar 16 and the decorative ring 14 are engaged, top lip 34 projects inwards over the inner threaded engagement surface 36, thereby covering most of the top of the flat top surface 26.

Threaded outside engagement surface 28 of collar 16 and inner threaded engagement surface 36 of decorative ring 14 have sufficient thread density and area so as to provide for a secure connection between base 12 and decorative ring 14.

Threaded outside engagement surface 28 of collar 16 and inner threaded engagement surface 36 of decorative ring 14, have corresponding heights such that the earring assembly when fully engaged causes top lip 34 of the decorative ring 14 to rest just over the top of the top surface 26 of collar 16 and the flat bottom surface 38 to rest against the flat top surface 30 of the annular flange 18.

Decorative ring element 14 could take the form of a threaded bezel, such as a decorative watch bezel, manufactured and sold by watch companies such as Guccio Gucci S. P. A., Birks Jewellers Inc., Citizen Watch Co. Ltd., and the Hearst Corporation. In such a case, the outer engagement surface 28 of the cylindrical collar 16 would be configured and dimensioned to accept such decorative watch bezels. This embodiment allows the earring wearer to coordinate the appearance of the earring assembly with commercially available watches that utilize such bezels.

Figure 4:
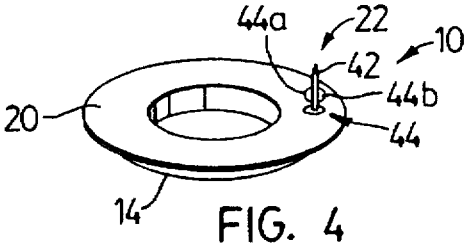
FIG. 4 is a bottom perspective view of the preferred embodiment of the present invention.
Figure 5A:
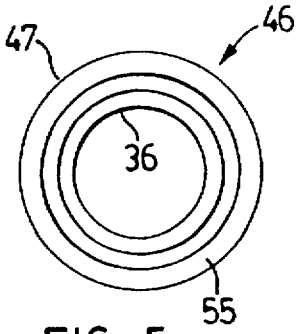
FIGS. 5*a* through 5*e* are top views of alternative decorative ring elements which may be selectively threaded onto the base portion of the subject earring assembly.
Figure 5B:
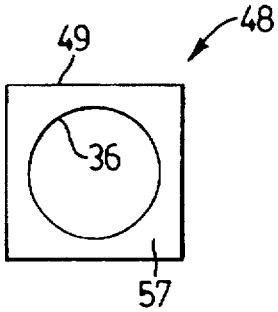
Figure 5C:
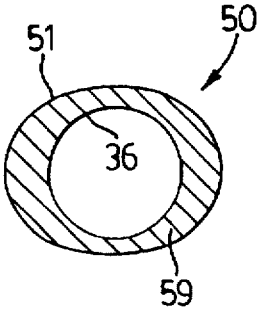
Figure 5D:
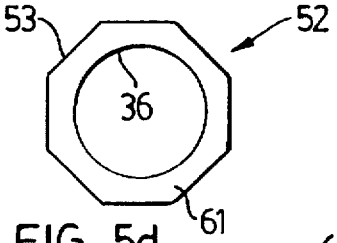
Figure 5E:
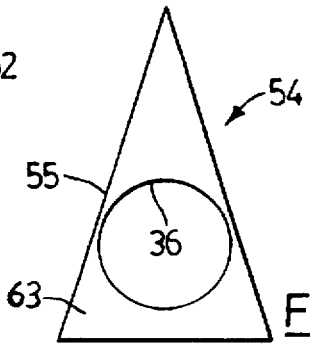

As best shown in FIG. 4, earring assembly 10 includes mounting apparatus 22 extending from the bottom surface 20 of flange 16 for releasably attaching flange 16 to a wearer. Mounting apparatus 22 may comprise a post 42 and clutch 44, suitable for mounting earring apparatus 10, although other mounting apparatus, such as clip-on earring mounts and dangling attachments could be used. Post 42 is adapted to extend through a pierced hole in an earlobe, and clutch 44 is adapted to be circumferentially fitted about the post 42 at a location behind an earlobe. Clutch 44, which is a standard commercially available item, compressingly engages the post 42 on the rear side of an earlobe and functions to prevent the post 42 from unintentionally separating therefrom. Clutch 44 includes a cooperating pair of wing clamps 44*a* and 44*b* which provide gripping surfaces to assist in sliding the clutch 44 onto or off the post 42.

Referring now to FIGS. 5*a* through 5*e*, shown therein are a number of alternative decorative ring elements 46, 48, 50, 52 and 54. Each of decorative rings 46, 48, 50, 52 and 54, has an inner threaded engagement surface 36 sized to be selectively mated with collar 16 of earring assembly 10, at the option of the wearer. As shown, the outer edges 47, 49, 51, 53 and 55, respectively, differ in size and shape, and each of the decorative rings 46, 48, 50, 52 and 54 may have different patterns and colours on their faces 55, 57, 59, 61 and 63. These design variations allow the wearer to utilize the earring assembly to create customized earrings with varied appearance.

In use, a wearer assembles earring assembly 10 by threading decorative ring 14 onto collar 16 in a clockwise manner until the threaded engagement surfaces are fully engaged, such that decorative ring 14 can no longer turn in a clockwise manner. The wearer can disassemble an engaged earring assembly 10 by unscrewing decorative ring 14 from collar 16 in a counter-clockwise manner until base 12 and decorative ring 14 are fully disengaged. In the preferred embodiment, the outer diameter of the annular flange 18 is larger than the outer diameter of the decorative ring 14 and both base 12 and decorative ring 14 have larger dimensions than those of a typical wearer's finger. As a result, the wearer may easily grasp base 12 and decorative ring 14 and assemble and disassemble the assembly through simple physical manipulation.

The subject invention accordingly provides an earring assembly with interchangeable decorative rings which allows the user to selectively choose and customize the earring's appearance, depending upon the mood of the wearer or the occasion. Since base 12 and decorative ring 14 are attached together by a secure threaded mechanism, inadvertent ornament detachment is prevented. As well, threaded structures typically provide a robust attachment interface which is not prone to premature deterioration or breakage through repeated use. Outer diameter of flange 18 is larger than decorative ring 14, so that when the earring assembly is fully engaged, the outer circumferential segment of flange 18 forms part of the visual aspect of the earring.

As will be apparent to persons skilled in the art, various modifications and adaptations of the structure described above are possible without departure from the present invention, the scope of which is defined in the appended claims.

I claim:

1. An earring assembly, comprising:

(a) a base comprising an annular flange having a n inner edge and an outer edge, and a cylindrical collar extending upwards therefrom, the collar having an outside engagement surface;

(b) attachment means coupled to the base for releasably attaching the base to a wearer's ear lobe; and (c) a removable decorative ring, being dimensioned to fit around the collar, and having an inside engagement surface shaped to mate with the outside engagement surface of the collar.

2. The earring assembly defined in claim 1, wherein the outside engagement surface of the collar and the inside engagement surface of the ring are threaded.

3. The earring assembly defined in claim 1, comprising a plurality of interchangeable decorative rings, each of the decorative rings being dimensioned to fit around the collar, and having an inside engagement surface shaped to mate with the outside engagement surface of the collar.

4. The assembly defined in claim 1, wherein the cylindrical collar extends upwardly along the inner edge of the annular flange.

5. The assembly defined in claim 1, wherein the cylindrical collar extends perpendicularly from the annular flange.

6. The assembly defined in claim 1, wherein the ring is a bezel having a threaded inner engagement surface, the collar has an outside diameter sized to receive the bezel and the outside engagement surface of the collar is threaded to mate with the threaded inside surface of the bezel.

7. The assembly defined in claim 1, wherein the annular flange face surface has a flat top.

8. The assembly defined in claim 1, wherein the annular flange has a rounded circumferential edge.

9. The assembly defined in claim 1, wherein the ring has a selected outer diameter, and the face surface of the annular flange has an outer diameter which is larger than the outer diameter of the ring.

10. The assembly defined in claim 1, wherein the ring has a circular outside edge.

11. The assembly defined in claim 1, wherein the ring comprises a lip which covers a portion of the collar when the ring is secured to the base.

12. The assembly defined in claim 1, wherein the ring is sized to hide most of the cylindrical collar after assembly.

13. The assembly defined in claim 1, wherein the base is composed of a precious metal alloy.

14. The assembly defined in claim 1, wherein the ring is composed of plastic.

15. The assembly defined in claim 1, wherein the attachment means comprise a post and clutch assembly.

* * * * *